US009510659B2

(12) United States Patent
Lim et al.

(10) Patent No.: US 9,510,659 B2
(45) Date of Patent: Dec. 6, 2016

(54) COSMETIC IMPLEMENT WITH DETACHABLE RECEPTACLE

(71) Applicant: HCT Group Holdings Limited, Santa Monica, CA (US)

(72) Inventors: Cindy Sean Yuei Lim, Santa Monica, CA (US); Megan Rene Langdon, Santa Monica, CA (US)

(73) Assignee: HCT Group Holdings Limited, Santa Monica, CA (US)

( * ) Notice: Subject to any disclaimer, the term of this patent is extended or adjusted under 35 U.S.C. 154(b) by 227 days.

(21) Appl. No.: 13/973,904

(22) Filed: Aug. 22, 2013

(65) Prior Publication Data

US 2015/0055998 A1 Feb. 26, 2015

(51) Int. Cl.
*A45D 34/04* (2006.01)
*A45D 34/00* (2006.01)

(52) U.S. Cl.
CPC ..... *A45D 34/045* (2013.01); *A45D 2034/007* (2013.01)

(58) Field of Classification Search
CPC ..... A45D 34/045
USPC ..... 401/99, 102, 107, 108, 115, 116, 118,401/119, 123, 124, 125, 126, 127, 128, 129
See application file for complete search history.

(56) References Cited

U.S. PATENT DOCUMENTS 3,130,433 A * 4/1964 John ..... A45D 34/045 132/317
3,886,618 A 6/1975 Paoletti
4,165,755 A 8/1979 Cassai
5,482,059 A 1/1996 Miraglia
7,172,357 B2 2/2007 Gueret
8,074,666 B2 12/2011 Piao
2010/0215422 A1* 8/2010 Carroll ..... A46B 7/023 401/99
2010/0224208 A1 9/2010 Thorpe et al.
2011/0176854 A1* 7/2011 Nobles ..... A45D 40/265 401/118
2011/0176856 A1 7/2011 Gardner et al.
2012/0294666 A1 11/2012 Jang
2013/0004226 A1* 1/2013 Breidenbach ..... A45D 34/06 401/17
2013/0051894 A1 2/2013 Lim

OTHER PUBLICATIONS

Lorac Pro Cream Eyeliner+Brush: Eyeliner, retrieved on May 29, 2013, at <<http://www.sephora.com/pro-cream-eyeliner-brush-P374705?skuId=1432400>> 4 pages.

(Continued)

*Primary Examiner* — David Walczak
*Assistant Examiner* — Joshua Wiljanen
(74) *Attorney, Agent, or Firm* — Seager, Tufte & Wickhem LLP

(57) ABSTRACT

A cosmetic implement includes a handle with an applicator coupled to a handle and a detachable receptacle coupled to the handle. The applicator and receptacle may be coupled to a same end of the handle or opposite ends of the handle. In some examples, the applicator may be retractable into the handle which serves as a housing. In some examples, the applicator may extend or retract corresponding to the removal or attaching of the detachable receptacle. In some examples, a cap may be coupled to the handle to serve as a housing for the applicator. In some examples, the cap may be disposed between the handle and the detachable receptacle.

10 Claims, 9 Drawing Sheets

(56) References Cited

OTHER PUBLICATIONS

Final Office Action for U.S. Appl. No. 13/217,095, mailed on Jan. 30, 2013 Cindy Lim et al., "Adjustable Cosmetics Applicator," 11 pages.
Non-Final Office Action for U.S. Appl. No. 13/217,095, mailed on Jun. 29, 2012, Cindy Lim et al., "Adjustable Cosmetics Applicator," 9 pages.
Sephora Collection, Pitch BlacK All-In-1 Waterproof Eye Liner, retrieved on May 29, 2013 <<http://www.sephora.com/ pitch-black-all-in-1-waterproof-eye-liner-P377198?skuId=1479070>> 4 pages.

* cited by examiner

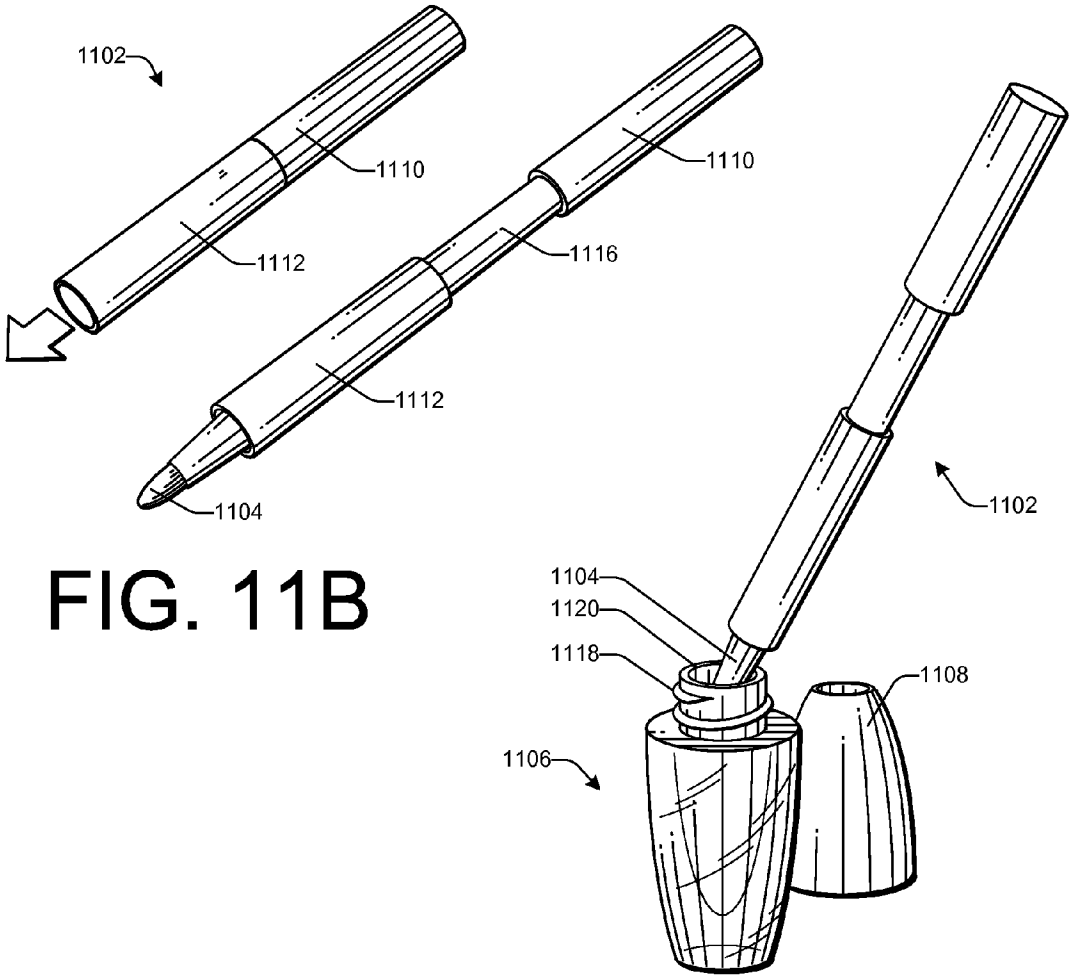
FIG. 11B
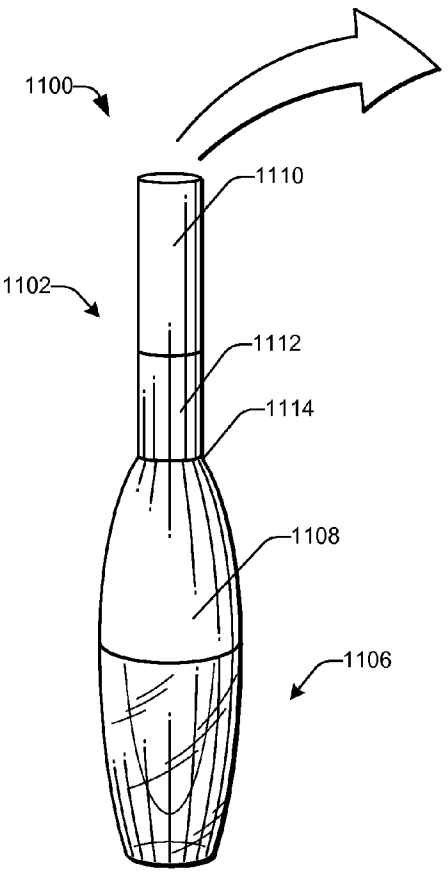
FIG. 11A
FIG. 11C

COSMETIC IMPLEMENT WITH DETACHABLE RECEPTACLE

BACKGROUND

A typical cosmetic brush contains a handle and a cosmetic applicator attached to one end of the handle. This combination of a handle and a cosmetic applicator provides a simple, low-cost and effective brush for the application of cosmetic products. However, the cosmetic products associated with these brushes are typically housed in their own individual cases. Thus, cosmetic users are forced to carry two separate items in order to apply their cosmetic products. Carrying two separate items is not only cumbersome, but it increases the likelihood of loss of a brush or product, thereby rendering the other useless. Additionally, carrying a brush and its cosmetic product separately increases the likelihood that a certain cosmetic product might not always be accompanied by the right type of applicator for its use. For example, one might wish to bring a flexible brush for applying a cosmetic product, such as blending, with them for the day, but might accidently bring a rigid brush instead, thus leaving the user unable to apply the product.

Hence, since different applicators use different cosmetic products, and because many types of applicators are not, or cannot, be housed in their corresponding cosmetic product cases, users are forced to carry two items which is cumbersome and increases the chance of losing an essential item.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

FIG. 11A is a front view of another example retractable cosmetic implement with a detachable receptacle assembly to house an applicator.

FIG. 11B is a front view of the retractable cosmetic implement in FIG. 11A in which the applicator is shown in retracted and extended positions.

FIG. 11C is a partial perspective view of the retractable cosmetic implement with a detachable receptacle shown in FIG. 11A configured to show the extended applicator being inserted into the detachable receptacle with the receptacle assembly being detached from the receptacle.

DETAILED DESCRIPTION

Overview

Figure 2:
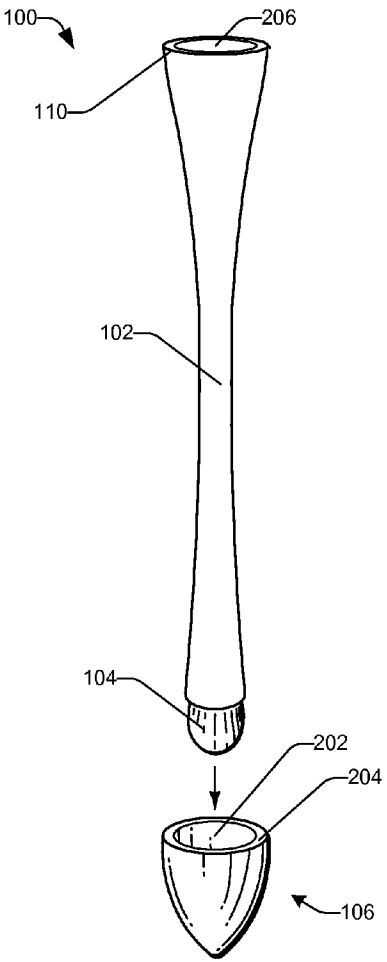
FIG. 2 is a front elevation view of the cosmetic implement of FIG. 1, illustrating a receptacle of the implement detached from a handle of the implement and ready to receive an applicator of the implement.

As discussed above, conventional cosmetic implements have a handle with a cosmetic applicator attached to one end of the handle. However, the cosmetic products associated with these brushes are typically housed in their own individual cases. Thus, users are required to carry two separate items in order to apply their cosmetic products, which is cumbersome and increases the chance of losing either a brush or its respective cosmetic product.

This disclosure is directed to cosmetic implements having a handle or body to which an applicator and a detachable receptacle for holding a cosmetic product are attached. As used herein, an "applicator" or "applicator head" may include any device used or designed for applying a substance or material to a surface. The applicator head may be chosen for a cosmetic implement corresponding to the cosmetic product that the detachable receptacle is designed to contain. By way of example and not limitation, the receptacle may contain an eye shadow product, a lip gloss product, an eyeliner product, a foundation product, a blush product, or the like. Depending on the product contained in the receptacle, the applicator may comprise, for example, a brush, a sponge, flocking, a pencil, a paddle, or the like.

In some examples, the applicator is coupled to a first end of the handle in a fixed position extending beyond the first end of the handle and the detachable receptacle is located at a second end of the handle. In other examples, the applicator may be coupled to the handle in a way which enables it to retract or extend relative to the handle, which serves as a housing for the applicator. In certain examples, the cosmetic implement may additionally or alternatively have a cap removably attached to house the applicator.

Generally, the cosmetic implement comprises an applicator, a handle, and a detachable receptacle. The detachable receptacle will have an opening sized to receive the applicator head to facilitate transferring the product housed in the receptacle onto the applicator. In some examples, an opening of the detachable receptacle may be closed off by the body of the handle when it is attached. In that case, the opening of the receptacle is disposed on a side proximate to the handle. In other examples, the detachable receptacle may have a removable lid or cap closing the opening to keep the product contained in the receptacle. In that case, the opening of the receptacle may be on a side of the receptacle proximate to the handle or a side distal from the handle. The detachable receptacle may be removably coupled to the handle of the cosmetic implement by a variety of attachment means, such as by snap fit, screw threads, a twist lock mechanism, magnetic force, interference fit, combinations of any of the foregoing, or the like.

In various examples, the applicator head may be extended or retracted relative to the circumference of the handle which may have a hollow body, or at least a hollow portion, to serve as a housing for the applicator head. According to certain examples, the applicator head may be retracted or extended relative to the housing corresponding to the sliding of a sliding mechanism disposed in a longitudinal channel in the handle. For example, a driving member may be located inside the circumference of the housing, having one end coupled to the sliding mechanism and another end coupled to the applicator head. This enables the sliding mechanism to engage the driving member to extend or retract the applicator head corresponding to the vertical movement the sliding mechanism makes by sliding along the longitudinal channel.

According to other examples, the applicator head may be retracted or extended relative to the circumference of the housing corresponding to rotation of a portion of the implement. In certain examples, the applicator may be retracted or extended at least partly in response to attaching or removing the detachable receptacle. For example, the detachable receptacle may be attached so that the removal of the receptacle engages an actuator, located within the circumference of the housing, to extend the applicator. Similarly, the attachment of the receptacle may engage the actuator to retract the applicator head.

According to certain examples, the cosmetic implement may be sized such that its first end, housing the retractable applicator head, fits inside a receptacle assembly. In some examples, the receptacle assembly includes a receptacle for holding cosmetic product and an attaching mechanism to couple the first end of the handle to the receptacle assembly. Additionally, the receptacle assembly may have a cap disposed between the receptacle for holding cosmetic product and the handle, the cap further having an opening to receive and end of the handle.

Multiple and varied example implementations and embodiments are described below. However, these examples are merely illustrative, and other implementations and embodiments of a cosmetic implement with a detachable receptacle may be implemented without departing from the scope of the disclosure.

Illustrative Cosmetic Implement with Detachable Receptacle

Figure 1:
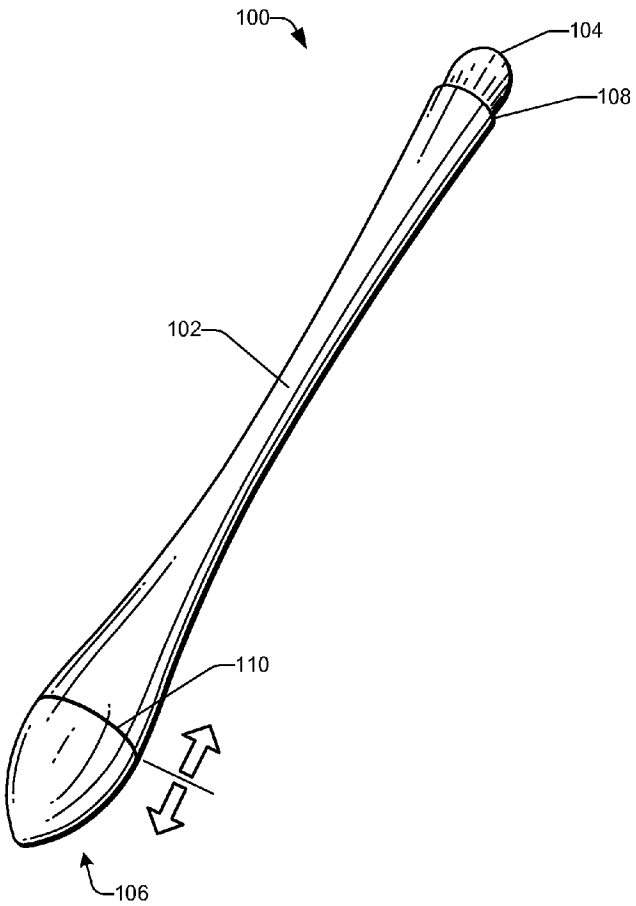
FIG. 1 is a perspective view of a cosmetic implement according to one illustrative example.

FIG. 1 is a perspective view of a cosmetic implement 100. FIG. 1 shows a cosmetic implement 100 having a handle 102, an applicator 104, and a receptacle 106. The applicator 104 may be coupled to a first end 108 of the handle 102 and the receptacle 106 may be coupled to a second end 110 of the handle 102, as shown in FIG. 1. The handle 102 and the receptacle 106 may be shaped such that when coupled together they form one continuous, smooth surface, as illustrated in FIG. 1. The handle 102 may be constructed at least partially of a rigid, semi-rigid, or flexible material such as metal, wood, glass, ceramic, plastic, and composites thereof. The handle 102 may be substantially linear with a curvilinear surface, as illustrated in FIG. 1, giving the cosmetic implement 100 an overall linear form-factor. In other examples, the handle 100 may be curved, bent, irregular, spherical, bulbous, a combination thereof, or any other shape suitable for gripping giving the cosmetic implement 100 an overall non-linear form-factor. The handle 102 may be solid, or may be hollow, or partially hollow to serve as a housing.

In the example of FIG. 1, the applicator 104 comprises a brush. In examples having a brush applicator, the applicator may comprise natural or synthetic fibers or filaments, metal bristles, or the like. In other examples, other types of applicators may be used, such as natural or synthetic sponge, flocking, a cosmetic pencil (e.g., oil or water based pencil), a paddle (e.g., silicon, rubber, wood, metal), or the like. In some embodiments, a cap (not shown) may be removably attached to the first end 108 of the handle 102 to house the applicator 104.

The receptacle 106 may hold cosmetic product in its interior. The receptacle 106 may be removably attached to the handle 106 at connection 110 by, for example, snap-fit, press-fit, screw threads, or one or more other engagement features. The receptacle 106 may be in the shape of a dome, as illustrated in FIG. 1, cylinder, cube, rectangular prism, or any other shape suitable for gripping and housing cosmetic product. The connection 110 between the handle 102 and the receptacle 106 may include an o-ring or other seal to prevent product from escaping the receptacle during non-use. The seal connection 110 may be made of materials including but not limited to, nitrile rubber, Buna-N, synthetic rubber, copolymer of acrylonitrile and butadiene, thermoplastic elastomer (TPE), silicon, or the like.

FIG. 2 is a front elevation view of the cosmetic implement 100 and illustrates the receptacle 106 detached from the handle ready to receive the applicator 104. The receptacle 106 has an interior 202 for holding cosmetic product and an opening with a circumference 204 sized to receive the applicator 104. In some examples, the detachable receptacle 106 may have a cap (not shown) disposed on or inside the circumference 204 to retain the cosmetic product. The detachable receptacle 106 may have an opening exposed when detached from the handle 102 revealing the cosmetic product as illustrated in FIG. 2. The interior of the handle 206 may be a solid material or may be hollow.

Figure 3:
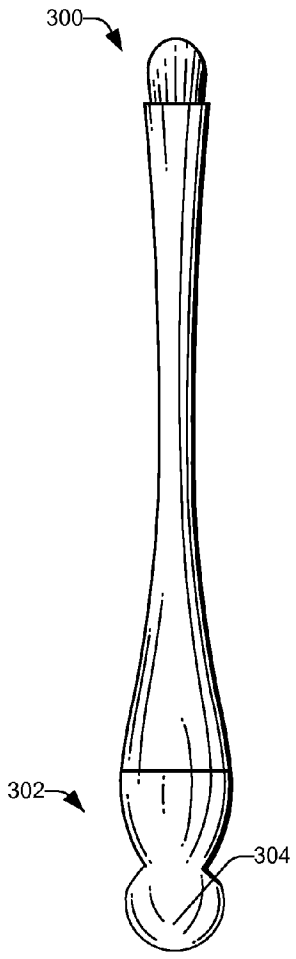
FIG. 3 is a front elevation view of another example cosmetic implement comprising an applicator, a handle, and a receptacle with a handle.

FIG. 3 is a front elevation view of an example cosmetic implement 300 illustrating another example receptacle 302 having a receptacle handle 304 for grasping and holding the receptacle 302. The receptacle handle 304 may comprise a paddle, knob, tab, ring, disk, or any other shape that enables grasping and holding of the receptacle 302.

Illustrative Retractable Cosmetic Implement with Detachable Receptacle

FIGS. 4-13 illustrate embodiments of example retractable cosmetic implements with detachable receptacles.

Figure 4:
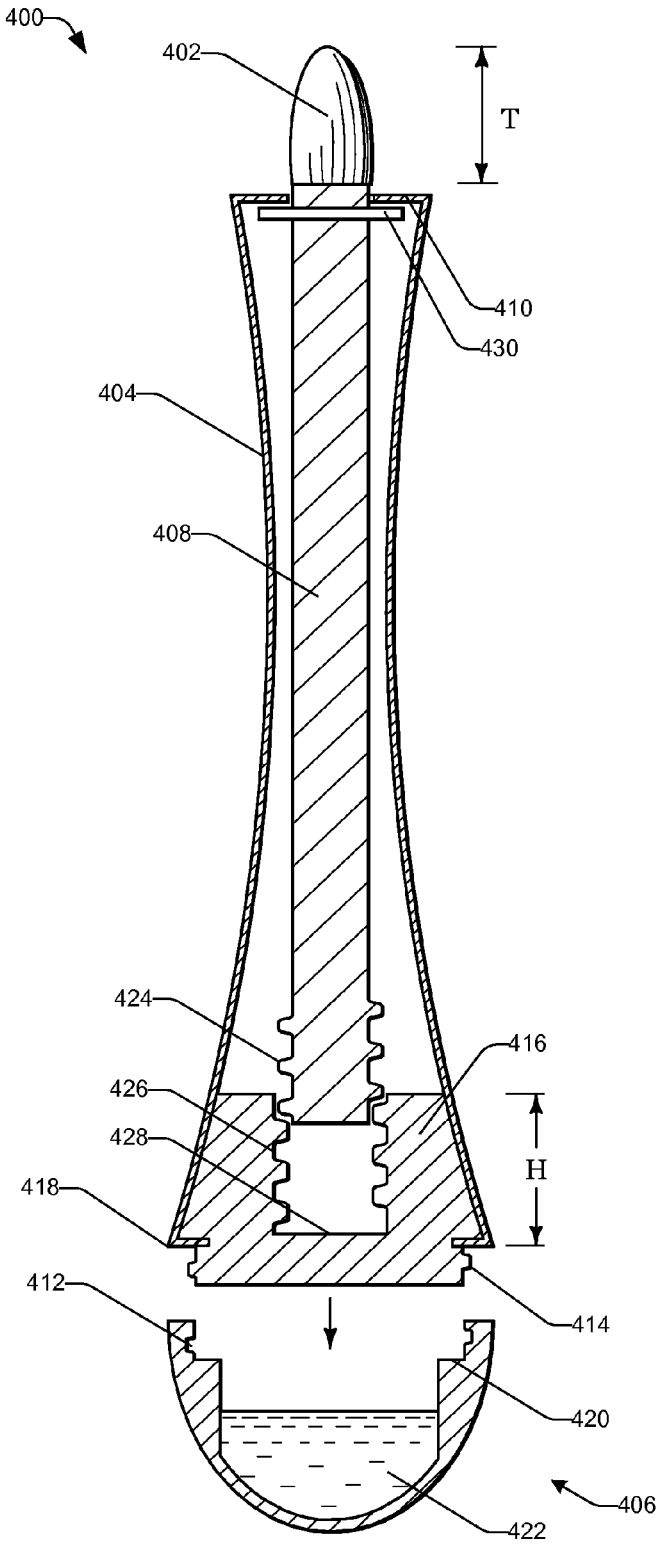
FIG. 4 is a cross-sectional view of one example of a retractable cosmetic implement with a detachable receptacle having an applicator which is retracted and extended by rotating the receptacle.

FIG. 4 is a cross-sectional view of an example retractable cosmetic implement 400 with an applicator 402, a body 404, and a detachable receptacle 406. As shown in FIG. 4, the applicator 402 may be coupled to a driving member 408, which is used to extend or retract the applicator head relative to a first end 410 of the body. As illustrated in FIG. 4, the body 404 may serve as a housing for the applicator 402 and driving member 408.

In the example of FIG. 4, the detachable receptacle 406 has a female thread 412 corresponding to a male thread 414 of a rotational body 416 disposed in the body 404. The female thread 412 and the male thread 414 may engage each other to couple the receptacle 406 to a second end 418 of the body 404. The detachable receptacle 406 may have an interior with a rim 420 where the end of the male thread 414 rests once fully threaded with the female thread 412, such that a cosmetic product 422 may be sealed within the detachable receptacle 406. In some embodiments, the male thread 414 and the female thread 412 may be switched.

In the example of FIG. 4, the driving member 408 has a male threaded end 424 used to engage a female threaded portion 426. The female threaded portion 426 is found in the rotational body 416. The rotational body 416 is able to rotate independent of the body 404 in a rotational direction within the circumference of the body 404.

The driving member 408, being able to rotate independently from the body 404, may extend or retract the applicator 402 corresponding to the attaching or detaching of the receptacle 406, thereby engaging the rotational body 416. That is, as the receptacle 406 is placed in contact with the second end 418 of the body 404 and rotated, female thread 412 of the receptacle 406 engages male thread 414 and secures the receptacle to the rotational body 416 at the second end of the body 404. Further rotation of the receptacle 406 causes the rotational body 416 to rotate within the body 404 such that the male threaded end 424 engages with the female threaded portion 426. This allows the driving member 408 to retract a distance H, where it rests on the stopping portion 428 of the rotational body 416.

By reversing the process and rotating the receptacle in the opposite direction, the rotational body 416 spins and forces the driving member 408 to extend the applicator 402 a distance T, corresponding to when an applicator collar 430 abuts the first end 410 of the body 404. In some embodiments, the distance H is equal to or greater than the distance T in order to ensure that the male threaded end 424 of the driving member will remain at least partially threaded in the female threaded portion 426 of the rotational body 416. Alternatively, the threads on the male threaded end 424 and the female threaded portion 426 could be switched.

Figure 5:
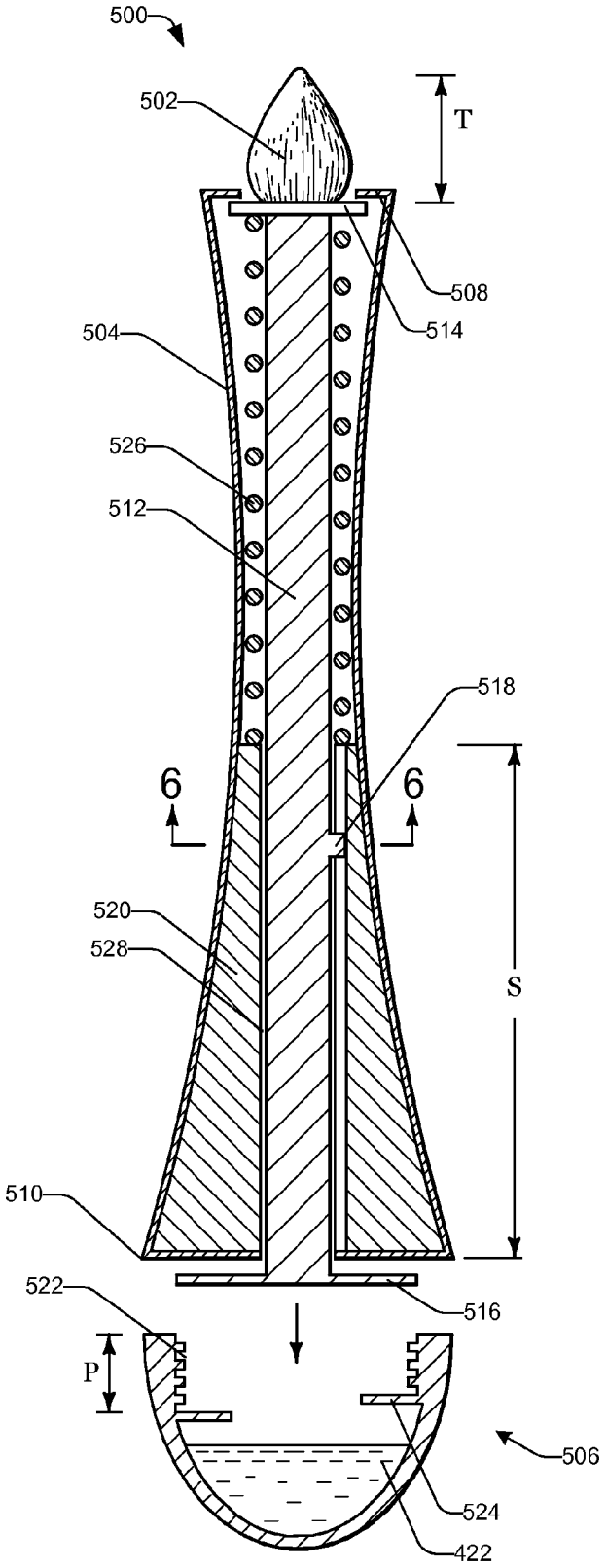
FIG. 5 is a cross-sectional view of another example of a retractable cosmetic implement with a detachable receptacle having an applicator which is retracted and extended by a spring mechanism.

FIG. 5 is a cross-sectional view of another example of a retractable cosmetic implement 500 with an applicator 502 coupled to a body 504. The body 504 additionally has a detachable receptacle 506 coupled to it. As illustrated in FIG. 5, the applicator 502 may be located on a first end 508 of the body 504, and the detachable receptacle may be coupled to a second end 510 of the body 504. Additionally, the applicator 502 may be coupled to a driving member 512 that is disposed within the body 504. The driving member 512 may comprise an applicator collar 514 which is disposed between the driving member 512 and the applicator 502. The driving member 512 may also have a male thread piece 516 located on an end opposite the applicator 502. The driving member 512 may further comprise a sliding notch 518 fixed along the side of the driving member 512 and further disposed inside a guiding piece 520 to index the driving member 512 to the guiding piece 520. The guiding piece 520 may be fixed to the interior of the body 504, thereby keeping the driving member 512 from rotating with respect to the body 504.

In the example of FIG. 5, the detachable receptacle 506 has a female thread 522 which corresponds to the male thread piece 516. The detachable receptacle has an interior edge 524 where the male thread piece 516 rests once fully threaded through the female thread 522. Once the male thread piece 516 is resting on the interior edge 524 of the detachable receptacle, the cosmetic product 422 is sealed inside the detachable receptacle 506.

As further illustrated in FIG. 5, a spring 526 may be disposed within the body 504 and disposed between the guiding piece 520 and the applicator collar 514. The receptacle 506 may then be attached by the male thread piece 516 with the female thread 522 until the male thread piece 516 is resting on the interior edge 524. When the male thread piece 516 is resting on the interior edge 524, the spring 526 is in a compressed state and the applicator 502 is retracted inside the body 504. Alternatively, the receptacle 506 may be detached by unthreading the male thread piece 516 from the female thread 522, thereby decompressing the spring 526 which in turn extends the applicator 502 relative to the first end 508 of the body 504. The spring 526 decompresses to the point where the applicator collar 514 engages the first end 508 of the body 504. Once the applicator collar 514 engages the first end 508 of the body 504, the applicator is ready to apply the cosmetic product 422.

The example cosmetic implement 500 allows for the applicator 502 to extend or retract a distance T. Additionally, the male thread piece 516 may be threaded with the female thread 522 a distance P. In some embodiments, the distance P is greater than or equal to the distance T, thereby allowing for complete housing of the applicator 502 within the body 504 of the cosmetic implement 500.

Figure 6:
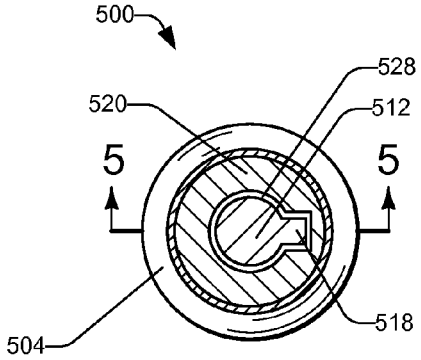
FIG. 6 is a cross-sectional view of the retractable cosmetic implement of FIG. 5 taken along line 6-6 in FIG. 5 and further illustrating the spring mechanism design for retracting and extending the applicator.

FIG. 6 is a cross-sectional view of the retractable cosmetic implement 500 taken along line 6-6 in FIG. 5. The sliding notch 518 fixed to the driving member 512 is disposed in a gap of the guiding piece 520 to keep the driving member 512 from moving rotationally with respect to the body 504. A vertical space 528 is shown between the driving member 512 and the guiding piece 520 to allow for vertical movement of the driving member 512.

Figure 7:
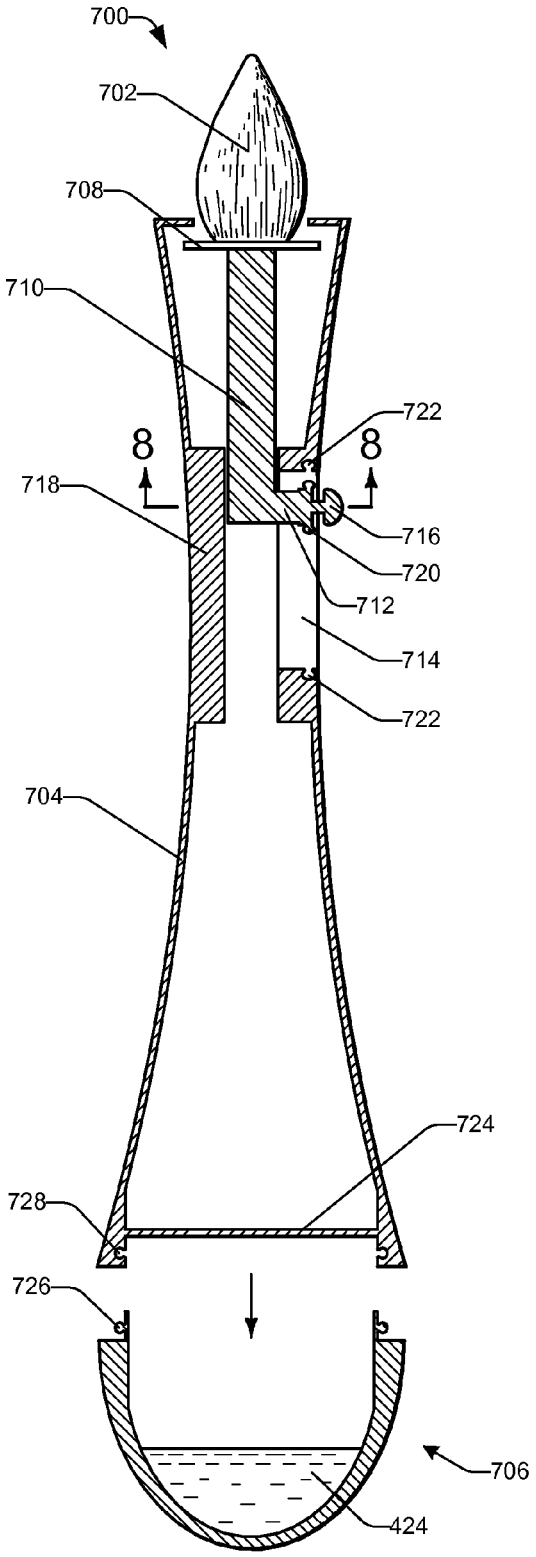
FIG. 7 is a cross-sectional view of another example of a retractable cosmetic implement with a detachable receptacle having an applicator which is retracted and extended by a sliding mechanism.

FIG. 7 is a cross-sectional view of another example of a retractable cosmetic implement 700 with an applicator 702 coupled to one end of a body 704 and a detachable receptacle 706 coupled to another end of the body 704. The applicator 702 has an applicator collar 708 coupled to a driving member 710. The applicator collar 708 and the driving member 710 are both housed within the circumference of the body 704. The driving member 710 is substantially linear in the longitudinal direction and has a transverse piece 712 at its second end, the second end being opposite the first end. The transverse piece 712 of the driving member 710 extends through a longitudinal channel 714 in the body 704 where it ends with a sliding mechanism 716 disposed to slide the length of the channel 714. The sliding mechanism is disposed in the longitudinal channel 714 to enable selective actuation.

The sliding mechanism, illustrated as a button in FIG. 7, engages the driving member 710 and extends or retracts the applicator 702 corresponding to the actuation of the sliding mechanism 716. The driving member 710 is contained within a guiding piece 718 to keep its motion substantially longitudinal during the retracting or extension of the applicator 702. During full extension or retraction of the applicator 702, the transverse piece 712 may be removably attached to the guiding piece 718 at the ends of each side of the longitudinal channel 714. As illustrated in FIG. 7, the transverse piece 712 may have plugs 720 on opposite vertical sides corresponding to notches 722 in the guiding piece 718 located on the ends of the channel 714 to lock the driving member 710 to the guiding piece 718. However, the transverse piece 712 may be removably attached to the guiding piece 718 at the ends of the channel 714 by snap-fit, press-fit, threads, or one or more other engagement features.

Another feature that FIG. 7 illustrates is that when the receptacle 706 is attached, a seal 724, which is coupled to the body 704, keeps the product 422 contained within the detachable receptacle 706. The detachable receptacle 706, as illustrated in FIG. 7, is removably attached using a rib 726 which fits into a groove 728 in the body 704. However, the detachable receptacle 706 may be removably attached to the body 704 by snap-fit, press-fit, threads, or one or more other engagement features.

As illustrated in FIG. 7, the attaching of the transverse piece 712 to the guiding piece 718 allows for a user to be able to apply pressure to the applicator 702 in a vertical direction, during cosmetic application for example, without having the applicator 702 retract into the body 704. Additionally, the attaching of the transverse piece 712 to the guiding piece 718 allows the user to hold any part of the body 704 when applying cosmetic product rather than having to hold the sliding mechanism 716 in the desired position for application.

Figure 8:
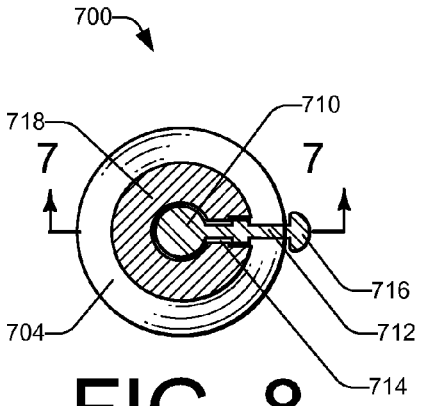
FIG. 8 is a cross-sectional view of the retractable cosmetic implement of FIG. 7 taken along line 8-8 in FIG. 7, further illustrating the sliding mechanism for retracting and extending the applicator.

FIG. 8 is a cross-sectional view of the example retractable implement 700 taken along line 8-8 in FIG. 7. The driving member 710 is shown disposed within the circumference of the guiding piece 718. The transverse piece 712 of the driving member 710 is shown extending through the longitudinal channel 714 to the exterior of the body 704. Located exterior to the body 704, the sliding mechanism 716 is disposed to slide along the longitudinal channel 714 where the sliding of the mechanism 716 engages the driving member 710 to extend or retract the applicator 702.

As illustrated in FIG. 8, the driving member 710 is able to slide in the longitudinal direction corresponding to the actuation of the sliding mechanism 716 along the longitudinal channel 714. The driving member 710 is disposed within the circumference of the guiding piece 718 to allow the driving member to move only in a substantially longitudinal direction, such that the applicator 702 is extended or retracted.

Figure 9C:
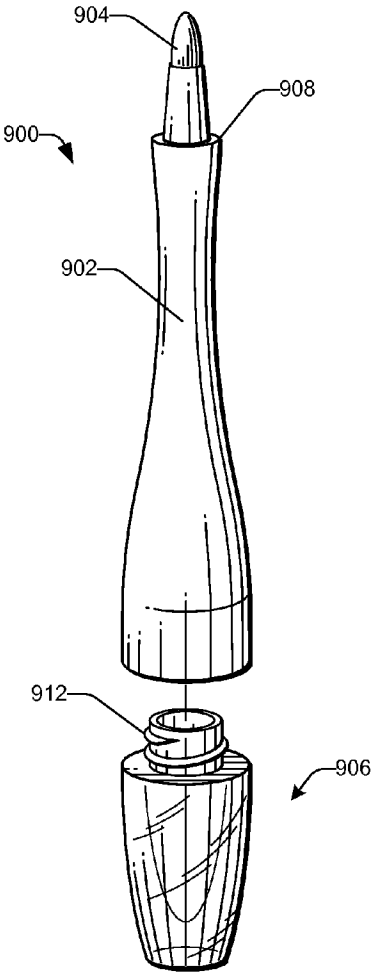
FIGS. 9A-9C are front views of a retractable cosmetic implement with a detachable receptacle shown in retracted, intermediate, and extended positions, respectively, to illustrate how an example cosmetic implement, such as the one illustrated in FIG. 4, extends an applicator.
Figure 9B:
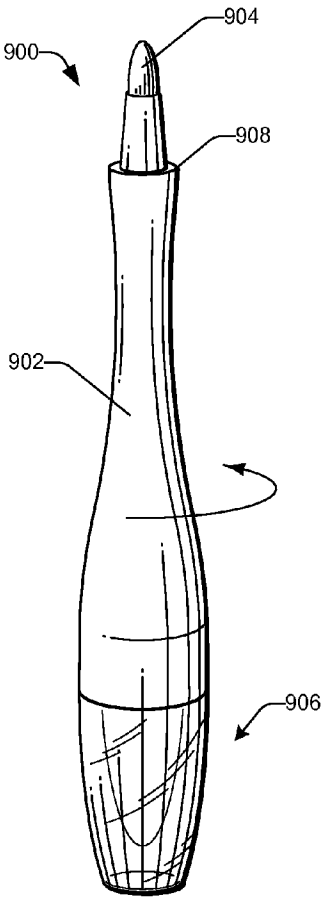
Figure 9A:
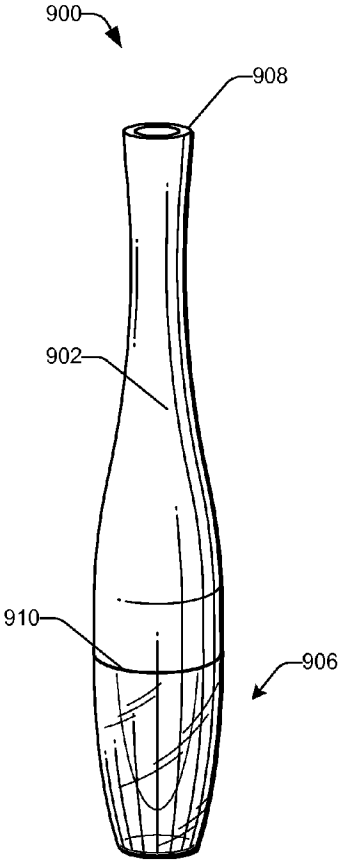

FIGS. 9A-9C are front views of an example retractable cosmetic implement 900 having a body 902, an applicator 904, and a detachable receptacle 906. The retractable cosmetic implement 900 includes a retraction mechanism similar to the one described with reference to FIG. 4. FIGS. 9A-9C illustrate how the applicator 904 may be selectively retracted within the body 902 (as shown in FIG. 9A) and extended out of the body 902 (FIGS. 9B and 9C). FIG. 9A illustrates the example retractable cosmetic implement 900 housing the applicator 904 within a first end 908 of the body 902. Additionally, as shown in FIG. 9A, the detachable receptacle 906 is attached to the body 902 at a second end 910 of the body 902. In this example, the detachable receptacle 906 serves as the actuation mechanism for retracting or extending the applicator 904.

FIG. 9B illustrates the example retractable cosmetic implement 900 having its applicator 904 extended relative to the first end 908 of the body 902 corresponding to a rotation of the body 902 with respect to the detachable receptacle 906. Rotation of the detachable receptacle 906 in a first direction causes the applicator 904 to extend from the first end 908 of the body 902. Further rotation of the detachable receptacle 906 in the same direction causes the detachable receptacle to unthread from the second end 908 of the body. The detachable receptacle 906, as illustrated in FIG. 9C, has a threads 912 which are used to removably attach the detachable receptacle 902 to the second end 910 of the body 904. In the illustrated embodiment, the detachable receptacle 906 is not detached until the applicator 904 is fully extended. That is, a friction force preventing the detachable receptacle 906 from being unthreaded is greater than a force required to rotate the retraction mechanism to extend the applicator 904. However, in other examples, the detachable receptacle 906 may unthread simultaneously with the applicator 904 being extended.

Figure 10C:
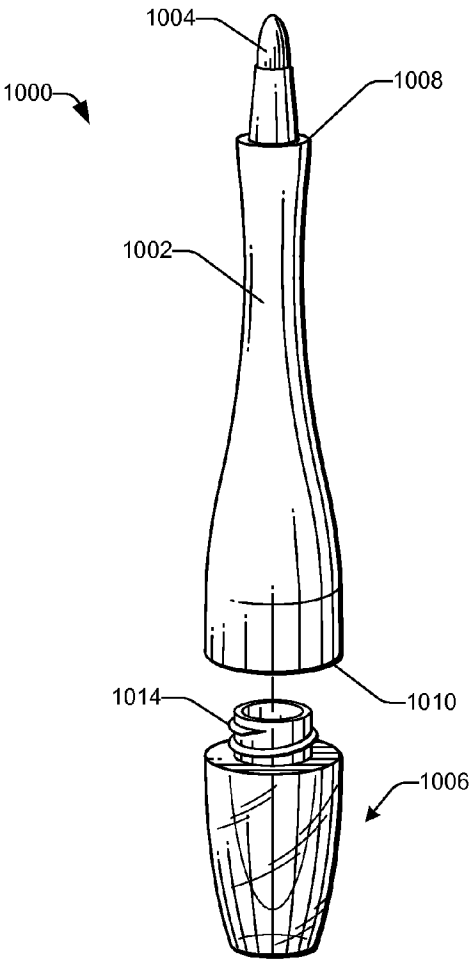
FIGS. 10A-10C are front views of a retractable cosmetic implement with a detachable receptacle shown in retracted, intermediate, and extended positions, respectively, to illustrate how an example cosmetic implement, such as the one illustrated in FIG. 5, extends an applicator.
Figure 10B:
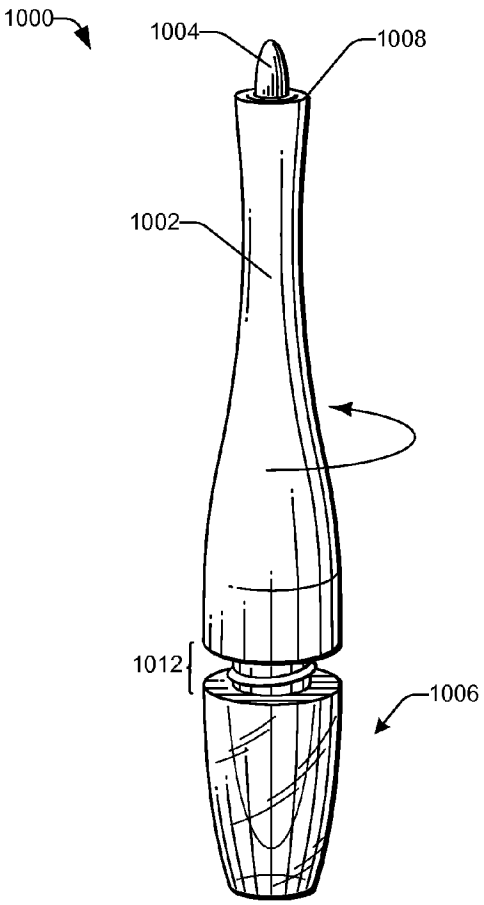
Figure 10A:
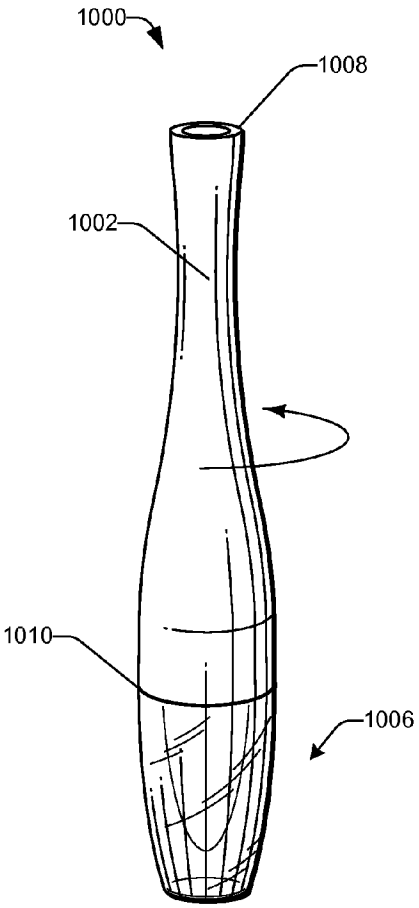

FIGS. 10A-10C are front views of another example retractable cosmetic implement 1000 having a body 1002 and illustrating how an applicator 1004 may be retracted into and extended out of an end of the body 1002. The retractable cosmetic implement 1000 of this example also includes a detachable receptacle 1006 coupled to an opposite end of the body 1002. FIG. 10A illustrates the example retractable cosmetic implement 1000 having the applicator 1004 retractable within a first end 1008 of the body 1002. Additionally, as shown in FIG. 10A, the detachable receptacle 1006 is attached to a second end 1010 of the body 1002 while the applicator 1004 is retracted within the body 1002. In this example, rotation of the detachable receptacle 1006 again causes the applicator 1004 to extend from the first end 1008 of the body 1002. However, in this example, rotation of the detachable receptacle 1006 extends the applicator 1004 while simultaneously detaching the detachable receptacle 1006.

FIG. 10B illustrates the example retractable cosmetic implement 1000 with applicator 1004 partially extended relative to the first end 1008 of the body 504. As shown in FIG. 10B, a gap 1012 between the detachable receptacle 1006 and the body 1002 illustrates that the partial extension of the applicator 1004 corresponds to a partial rotation of the body 1002 with respect to the detachable receptacle 1006. However, in practice, the gap may or may not actually exist during operation of the cosmetic implement 1000.

FIG. 10C illustrates cosmetic implement 1000 having the applicator 1004 fully extended with respect to the first end 1008 of the body 1002. Additionally, FIG. 10C illustrates that when the applicator 1004 is fully extended, the detachable receptacle 1006 is totally detached from the body 1002. As shown in FIG. 10C, the detachable receptacle 1006 may comprise threads 1014 as the mechanism by which the detachable reservoir 1006 is removably coupled to the body 1002. FIGS. 10A-10C illustrate how a user wanting to apply a cosmetic product may detach the receptacle 1006 and have the applicator 1004 extend corresponding to the detaching of the receptacle 1006.

FIGS. 11A-11C illustrate yet another example of a retractable cosmetic implement 1100 having a body 1102, an applicator 1104, a detachable receptacle 1106 used to contain product, and a cap 1108 disposed between the body 1102 of the instrument and the detachable receptacle 1106.

FIG. 11A is a front view of an example of the retractable cosmetic implement 1100 with the body 1102, comprising of a first section 1110 and a second section 1112, removably coupled to the cap 1108 and the detachable receptacle 1106. As shown in FIG. 11A, the cap 1108 may be disposed between the body 1102 and the detachable receptacle 1106. As illustrated in FIG. 11A, the body 1102 may be removably coupled to the cap 1108 at cap opening 1114. Additionally, the cap 1108 may serve as a housing for a portion of the second section 1112.

FIG. 11B is a front view of the body 1102 from the example retractable cosmetic implement 1100. The body 1102 is able to extend an applicator 1104 from the second section 1112 corresponding to a retracting mechanism housed within the body 1102. However, in an alternative embodiment, the applicator 1104 may be extendable from the first section 1110 of the body 1102. As further illustrated in FIG. 11B, the retracting mechanism housed in the body

1102 extends or retracts the applicator corresponding to a sliding motion of the second section 1112, along a sliding piece 1116, with respect to the first section 1110. The retracting mechanism housed in the body 1102 of the retractable cosmetic implement 1100 may include a system of gears, a ratchet system, a system of springs, or any combination thereof. As illustrated in FIG. 11B, the retracting mechanism may serve as an extractor or retractor of the applicator 1104 corresponding to the sliding of the second section 1112 with respect to the first section 1110.

In some embodiments, the sliding piece 1116 may be fixed to the first section 1110 and may houses a ratchet piece comprising evenly teeth and extending vertically through the body 1102. The applicator 1104 in such embodiments is coupled to a ratchet piece, housed in the second section 1112, having spaced teeth corresponding to ratchet piece housed in the first section 1110. When the teeth of each ratchet piece are engaged, the applicator 1104 is extended from the second section 1112 corresponding to a sliding of the second section 1112 along the sliding piece 1116 caused by the ratchet pieces engaging.

FIG. 11C illustrates a use of the example retractable cosmetic implement 1100 in which receptacle 1106 and the cap 1108 are disassembled into separate parts. As illustrated in FIG. 11C, the receptacle 1106 may be removably attached from the cap 1108 by threads 1118. The body 1102 is shown in its extracted state, as illustrated in FIG. 11B, wherein the applicator 1104 is extended from the body 1102. As further shown in FIG. 11C, the receptacle has an opening 1120 with a circumference sized to receive the applicator 1104. The detachable receptacle 1106 may contain product that the applicator 1104 is receiving for application by the user.

Illustrative Detachable Receptacle

Figure 12:
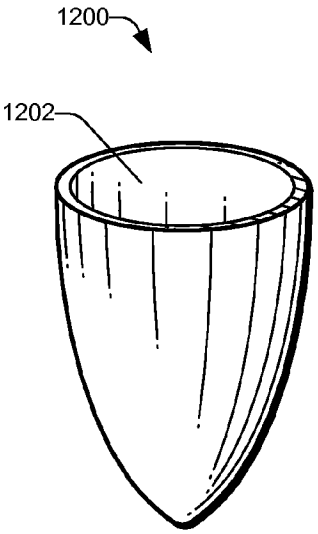
FIG. 12 is a front view of a detachable receptacle according to one illustrative example.

FIG. 12 is a front view of a detachable receptacle 1200 according to one illustrative example. The receptacle 1200 may be dome-shaped or conical shaped, as illustrated, or any other shape comprising a substantially hollow interior 1202, which may hold a cosmetic product. In one example, not shown, the detachable receptacle 1200 may include a handle, a ring, a clasp, or other feature by which to hold the detachable receptacle 1200 by hand or on a strap or chain. The detachable receptacle 1200 may be removably attached to a cosmetic implement by press-fit, snap-fit, internal threads, or by one or more attaching features.

Figure 13:
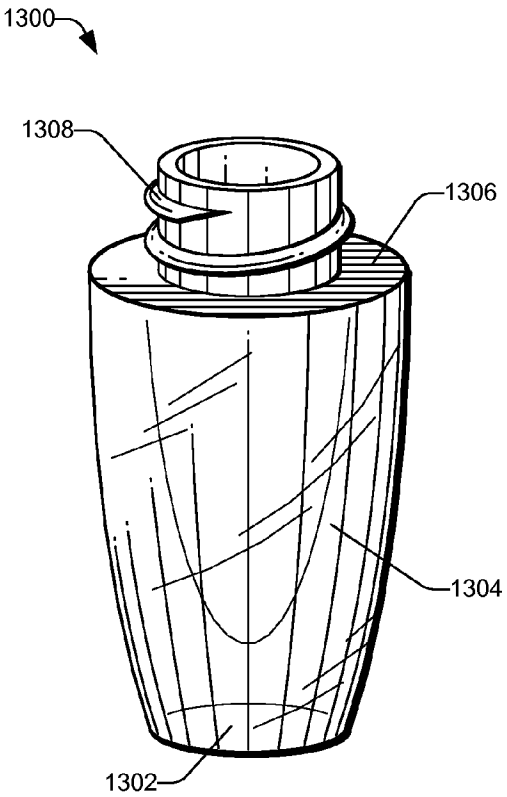
FIG. 13 is a front view of a detachable receptacle according to another illustrative example.

FIG. 13 is a front view of a detachable receptacle 1300 according to another illustrative example. The reservoir 1300 has a circular flat base 1302 on which to stand upright on a substantially planar surface. The receptacle 1300 of this example has substantially curvilinear sides 1304 extending up to a circular top edge 1306 of the receptacle. Extending from the receptacle is a male thread 1308 for coupling the receptacle 1300 to a cosmetic implement with a corresponding female thread. Alternatively, in other embodiments the male and female threads could be reversed.

Figure 14:
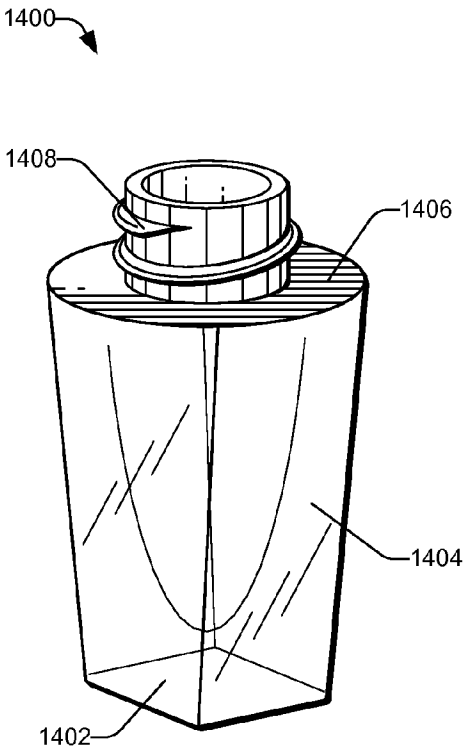
FIG. 14 is a front view of a detachable receptacle according to another illustrative example.

FIG. 14 is a front view of a detachable receptacle 1400 according to another illustrative example. The reservoir 1400 has square, flat base 1402 on which to stand upright on a substantially planar surface. The base 1402 has substantially square sides 1404 extending from it, which in turn gradually become substantially circular as they extend up to a circular top rim 1406 of the receptacle. Extending from the reservoir is a male thread 1408 for coupling the receptacle 1400 to a cosmetic implement with a corresponding female thread. Alternatively, in other embodiments the male and female threads could be reversed.

CONCLUSION

Although this disclosure uses language specific to structural features and/or methodological acts, it is to be understood that the scope of the disclosure is not necessarily limited to the specific features or acts described. Rather, the specific features and acts are disclosed as illustrative forms of implementation and numerous variations are also within the scope of this disclose. The components shown in the figures may be combined as desired to create a cosmetic implement having various configurations. The components shown in the figures may be rearranged, modified, duplicated, and/or omitted entirely in some configurations without departing from the scope of the disclosure.

What is claimed is:

1. A retractable cosmetic implement comprising:

a body;

an applicator coupled to the body;

a retracting mechanism disposed in the body to selectively retract or extend the applicator relative to the body; and a receptacle for holding cosmetic product removably coupled to the body;

wherein the body comprises a receiving structure for receiving the receptacle and the receiving structure is linked to the retracting mechanism such that coupling the receptacle to the receiving structure facilitates actuation of the retracting mechanism to retract the applicator.

2. The retractable cosmetic implement of claim 1, wherein the retracting mechanism comprises: an actuator disposed inside the body which is engaged to extend or retract the applicator, relative to the body, corresponding to the removing or attaching of the receptacle.

3. The retracting mechanism of claim 2, wherein the applicator is extended or retracted corresponding to a rotational actuation of the actuator.

4. The retractable cosmetic implement of claim 1, wherein a cap is disposed between the receptacle and the body.

5. The retractable cosmetic implement of claim 4, wherein the applicator is on a same side of the body as the cap.

6. The retractable cosmetic implement of claim 4, wherein the applicator is on an opposite side of the body as the cap.

7. The retractable cosmetic implement of claim 1, wherein the receptacle comprises a proximal end, which is configured to be removably coupled to the body, and a distal end opposite the proximal end.

8. The retractable cosmetic implement of claim 7, wherein the distal end of the receptacle is substantially dome-shaped or conical and the proximal end has an opening.

9. The retractable cosmetic implement of claim 7, wherein the distal end of the receptacle has a flat base on which to support the cosmetic implement in an upright position on a planar surface.

10. The cosmetic implement of claim 7, wherein a distal end of the receptacle has a handle to facilitate grasping and holding the receptacle during use.

* * * * *